US011819903B2

(12) United States Patent
Colugnati et al.

(10) Patent No.: US 11,819,903 B2
(45) Date of Patent: Nov. 21, 2023

(54) HEAT EXCHANGER AND CORRESPONDING PRODUCTION METHOD

(71) Applicant: CGA Technologies S.r.l., Cividale del Friuli (IT)

(72) Inventors: Giorgio Colugnati, Romans d'Isonzo (IT); Pietro Giamei, Gorizia (IT)

(73) Assignee: A. RAYMOND ET CIE, Grenoble (FR)

( * ) Notice: Subject to any disclaimer, the term of this patent is extended or adjusted under 35 U.S.C. 154(b) by 264 days.

(21) Appl. No.: 17/418,517

(22) PCT Filed: Dec. 27, 2019

(86) PCT No.: PCT/IT2019/050279
§ 371 (c)(1),
(2) Date: Jun. 25, 2021

(87) PCT Pub. No.: WO2020/136688
PCT Pub. Date: Jul. 2, 2020

(65) Prior Publication Data

US 2022/0097121 A1 Mar. 31, 2022

(30) Foreign Application Priority Data

Dec. 27, 2018 (IT) ..... 102018000021274

(51) Int. Cl.
*B21D 53/04* (2006.01)
*F25B 39/02* (2006.01)
*F28F 3/14* (2006.01)

(52) U.S. Cl.
CPC ..... *B21D 53/045* (2013.01); *F25B 39/024* (2013.01); *F28F 3/14* (2013.01)

(58) Field of Classification Search
CPC ..... B21D 53/045; F25B 39/024; F28F 3/14
USPC ..... 165/168
See application file for complete search history.

(56) References Cited

U.S. PATENT DOCUMENTS 2,514,469 A * 7/1950 Burkhardt ..... B21D 53/045 228/183
3,020,633 A * 2/1962 Archibald ..... B21D 53/045 62/515
3,052,964 A * 9/1962 Heuer ..... B21D 53/045 29/890.03
3,059,324 A * 10/1962 Goff ..... B21D 53/045 228/234.3
3,114,202 A * 12/1963 Wenger ..... B21D 53/045 228/118
3,141,940 A * 7/1964 Horowitz ..... H01H 29/18 335/62
3,247,590 A 4/1966 Perlick et al.
(Continued)

OTHER PUBLICATIONS

Int'l Search Report and Written Opinion dated Mar. 25, 2020 in Int'l Application No. PCT/IT2019/050279.

*Primary Examiner* — Justin M Jonaitis
(74) *Attorney, Agent, or Firm* — Panitch Schwarze Belisario & Nadel LLP

(57) ABSTRACT

Heat exchanger, and production method, including at least two plates of metal material, overlapping and reciprocally joined together so as to define a perimeter edge of the heat exchanger, and at least one circuit for the passage of a heat-carrier fluid defined by at least one or more heat exchange channels made between the plates.

9 Claims, 4 Drawing Sheets

(56) References Cited

U.S. PATENT DOCUMENTS

| | | | | |
|---|---|---|---|---|
| 3,314,475 | A * | 4/1967 | Valyi | F28F 3/14 165/170 |
| 3,442,001 | A * | 5/1969 | Canteloube | B21D 53/045 29/411 |
| 3,465,568 | A * | 9/1969 | Jonason | B21D 53/045 29/890.039 |
| 4,209,885 | A | 7/1980 | Winter | |
| 7,134,484 | B2 * | 11/2006 | Mok | F28F 3/12 257/E23.098 |
| 2011/0083834 | A1 * | 4/2011 | Braun | H02K 5/203 29/890.038 |
| 2015/0260464 | A1 * | 9/2015 | Cole | F28F 9/26 165/185 |
| 2018/0266738 | A1 | 9/2018 | Li et al. | |

* cited by examiner

HEAT EXCHANGER AND CORRESPONDING PRODUCTION METHOD

CROSS-REFERENCE TO RELATED APPLICATIONS

This application is a Section 371 of International Application No. PCT/IT2019/050279, filed Dec. 27, 2019, which was published in the English language on Jul. 2, 2020, under International Publication No. WO 2020/136688 A1, which claims priority under 35 U.S.C. § 119(b) to Italian Application No. 102018000021274, filed Dec. 27, 2018, the disclosures of each of which are incorporated herein by reference.

FIELD OF THE INVENTION

The present invention concerns a heat exchanger and the corresponding production method.

In particular, the present invention concerns a plate-type heat exchanger, or better, a heat exchanger made with two or more plates overlapping and joined together, between which a circuit is made in which a heat-carrier fluid is made to flow.

BACKGROUND OF THE INVENTION

Plate-type heat exchangers are known which are used, for example, as refrigerating or evaporator plates, inside which a heat-carrier fluid, gaseous or liquid, is made to pass.

Examples of these plate-type heat exchangers can be found in US 2015/0260464 and in US 2018/0266738.

Compared to the other types, plate-type heat exchangers have a reduced thickness, a large heat exchange surface, a better heat exchange coefficient, as well as simplified maintenance operations, in order to meet particular application needs from a sizing, cost and practical point of view.

These known heat exchangers can comprise two or more plates made of metal material, in particular aluminum or aluminum alloys, overlapping and joined together with heating and/or rolling processes, that is, with the technique also known as "Roll-Bonding", an example of which is described in U.S. Pat. No. 2,690,002.

This production technique provides that a detaching material is deposited on at least one of the two plates to be joined, according to a pattern that is predefined and coordinated with the shape of the passage channels to be obtained, in order to define the transit circuit of the heat-carrier fluid, that is, the printed circuit.

Subsequently, the two plates are made to overlap with each other and made to pass through at least one pair of rolling rollers/cylinders. Before rolling, the two plates are heated to a temperature lower than their melting temperature.

The rolling action allows to weld the two plates together on the entire surface of reciprocal contact, except for the surface portions affected by the detaching material.

Subsequently, in proximity to at least one peripheral edge of the plates, and where there is a portion of detaching material, at least one slit is made between the two plates suitable to house a device to deliver compressed air. The pressure of the air that is delivered has to be high enough to deform at least one of the two plates, in correspondence with the detaching material and along the entire deposition path thereof. The deformation of at least one of the two plates therefore allows to define the channels intended for the passage of the heat-carrier fluid.

The rolling process as above, required for the production of heat exchangers with Roll-Bonding technology can be applied to already pre-cut plates, which are subsequently trimmed along a shearing perimeter, or to continuous overlapping strips between which the detaching material is deposited; after rolling the strips are cut or sheared to size, along a pre-defined shearing perimeter, in order to obtain the plates. The precut strips or plates are typically made of aluminum or aluminum alloy.

This rolling process, both in the case of continuous strips being used and also pre-cut plates, can present some problems with regard to the rolling tolerances.

These problems, due to the process of elongation of the material as a consequence of its compression during the rolling process, cause a certain difficulty in determining the exact position of the heat exchange circuit made between the two plates. Identifying the precise reference points in the circuit is important, for example, to allow precise cutting or trimming operations, both in the case of a pre-cut plate to be trimmed, and also, even more, in the case of continuous strip.

In order to try to overcome these problems of elongation of the material, when defining the circuits during the design phase, nominal extension sizes are often used which are smaller than the surface to be covered, which, however, do not guarantee the maximum coverage of the areas of the heat exchanger that would instead be available, thus leading to non-optimized and often approximate solutions.

In other words, the circuitry, that is, the channels where the heat exchange fluid circulates, is maintained, during the design phase, at a safe distance from the edge of the heat exchanger, in order to take into account the uncontrollable elongations of the material of the plates that can occur during the rolling process.

For example, consider that for a rectangular heat exchanger, which has a long side of about 1 m and a short side of about 0.5 m, it is necessary to provide a safety distance of the circuit from the edge of the heat exchanger even greater than 40 mm.

The heat exchanger obtained by means of the Roll-Bonding process therefore has heat exchange channels which are very, in some cases excessively, distanced from the edges of the plate, therefore it is difficult to use these heat exchangers to, for example, cool zones close to the edges of the heat exchanger.

In FIG. 5, which shows an example of Roll-Bonding exchanger of the state of the art, the distance D0 of the circuit for the passage of the heat exchange fluid with respect to the edge of the plate is at least 36-40 mm, which leads to a loss of efficiency and performance of the exchanger as a whole.

The uncontrolled phenomena of elongation, and therefore the need to provide this safety distance from the edges, also prevent any identification of at least two exact points, distant from each other in the rolling direction of the plates, in which a channel of the heat exchanger can certainly be found, therefore it is extremely difficult to establish, during the design phase, the positioning of elements such as inlet and outlet connectors of the heat-carrier fluid, which have to be applied in defined positions and have to necessarily intercept the channels of the heat exchanger near the edges of the exchanger.

Other limitations and disadvantages of conventional solutions and technologies will be clear to a person of skill after reading the remaining part of the present description with reference to the drawings and the description of the embodiments that follow, although it is clear that the description of the state of the art connected to the present description must not be considered an admission that what is described here is already known from the state of the prior art.

There is therefore a need to perfect a heat exchanger and a corresponding production method which can overcome at least one of the disadvantages of the state of the art.

One purpose of the present invention is to define a method to produce a heat exchanger which can also be used for applications in which it is necessary to guarantee a heat exchange, therefore cooling or heating, also in zones close to the external or perimeter edge of the heat exchanger.

Another purpose of the present invention is to define a method to produce a heat exchanger which allows to identify at least two exact points in the rolling direction in which a channel of the heat exchanger can certainly be found, thus allowing to position, during the design phase, elements such as inlet and outlet connectors of the heat-carrier fluid, which have to be applied in defined positions and have to necessarily intercept the channels of the heat exchanger.

Another purpose of the invention is a method to produce a heat exchanger, in particular a heat exchanger obtained with Roll-Bonding technology, which offers possibilities of heat exchange even in proximity to the external or perimeter edge of the heat exchanger, and which offers the possibility of defining, in the design phase, two or more exact points of the heat exchange circuit which is made in the heat exchanger on which it will be possible to safely intercept the channeling.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, the invention concerns a new method to produce a heat exchanger comprising at least two plates of metal material, overlapping and joined together so as to define a perimeter edge of the heat exchanger and at least one circuit for the passage of a heat-carrier fluid defined by at least one or more heat exchange channels made between the plates.

The production method also provides, in a known manner, to pass the plates through a rolling unit, and a subsequent step of shearing or trimming with respect to a pre-defined shearing perimeter.

According to one aspect of the invention, the circuit is provided with at least one heat exchange portion having at least one closing edge which is made in close proximity to the perimeter edge of the heat exchanger, that is, at a minimum distance from the perimeter edge, wherein the production method provides that the closing edge is closed in the finishing step, that is, in the final step of producing the heat exchanger.

In particular, the method according to the invention provides that the heat exchange portion, that is, the channels for the circulation of the heat exchange fluid, extends beyond the shearing perimeter, and that following the shearing the exposed part of the channel that is generated as a result of the shearing is closed in the finishing step of the plate.

In this way, the heat exchange portion can be taken into an extremely close position to the perimeter edge of the plate, thus increasing the heat exchange efficiency of the exchanger as a whole.

Advantageously, by means of the present heat exchanger and by providing at least one heat exchange portion having at least one closing edge which is made in proximity to the perimeter edge of the heat exchanger, that is, at a minimum distance from the perimeter edge, it is possible to use the present heat exchanger to cool or heat zones located in proximity to the perimeter edge of the heat exchanger.

In the method to produce the heat exchanger according to the present invention, as mentioned, the heat exchange areas of the plates voluntarily exceed the predefined limits of the shearing perimeter, and the edges of the plates are closed together during the finishing step.

According to another aspect of the invention, the distance between the channels of the heat exchange circuit and the perimeter edge of the exchanger, thanks to the closure of the edge during the finishing step, can be variable from about 3 mm to about 7 mm.

In some embodiments, the width of the heat exchange portion can be greater than the width of a single heat exchange channel, with sizes that can range from about 10 mm to any useful measure whatsoever.

According to another aspect of the invention, the heat exchange portion can be defined by at least one channelized area made on the heat exchange circuit and provided with a series of branching points.

At least one hole for the inlet or outlet of the heat-carrier fluid to/from the heat exchanger can also be made in the heat exchange portion.

Therefore, the present invention concerns a method to produce a heat exchanger comprising:

- at least one deposition step, to deposit on at least one of two plates a detaching material according to the shape and the path of the heat exchange circuit to be obtained, wherein the heat exchange circuit voluntarily extends beyond the pre-defined shearing perimeter of each plate;
- the overlapping and hot rolling of the plates with in the middle the template of the circuit made of detaching material;
- the introduction of a fluid under pressure from at least one aperture made on a perimeter edge made by overlapping the plates and consequent deformation of at least one of the plates in correspondence with the detaching material, thus obtaining, by inflation, one or more channels and at least one heat exchange portion provided with a closing edge situated in correspondence with or in proximity to the perimeter edge of the heat exchanger, that is, at a minimum distance from the perimeter edge, wherein the closing edge is closed in the step of finishing or trimming the perimeter edge of the plate.

According to another aspect of the present method, in order to produce the heat exchange portion at least one at least one strip of detaching material is disposed between the plates beyond the perimeter edge of the heat exchanger.

The closing edge can be made by bending the perimeter edge of the plates.

The closing edge can also be made by welding the plates in proximity to the perimeter edge of the heat exchanger.

The closing edge can be made by gluing the plates in proximity to the perimeter edge and subsequent shearing.

These and other aspects, characteristics and advantages of the present disclosure will be better understood with reference to the following description, drawings and attached claims. The drawings, which are integrated and form part of the present description, show some embodiments of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Figure 1:
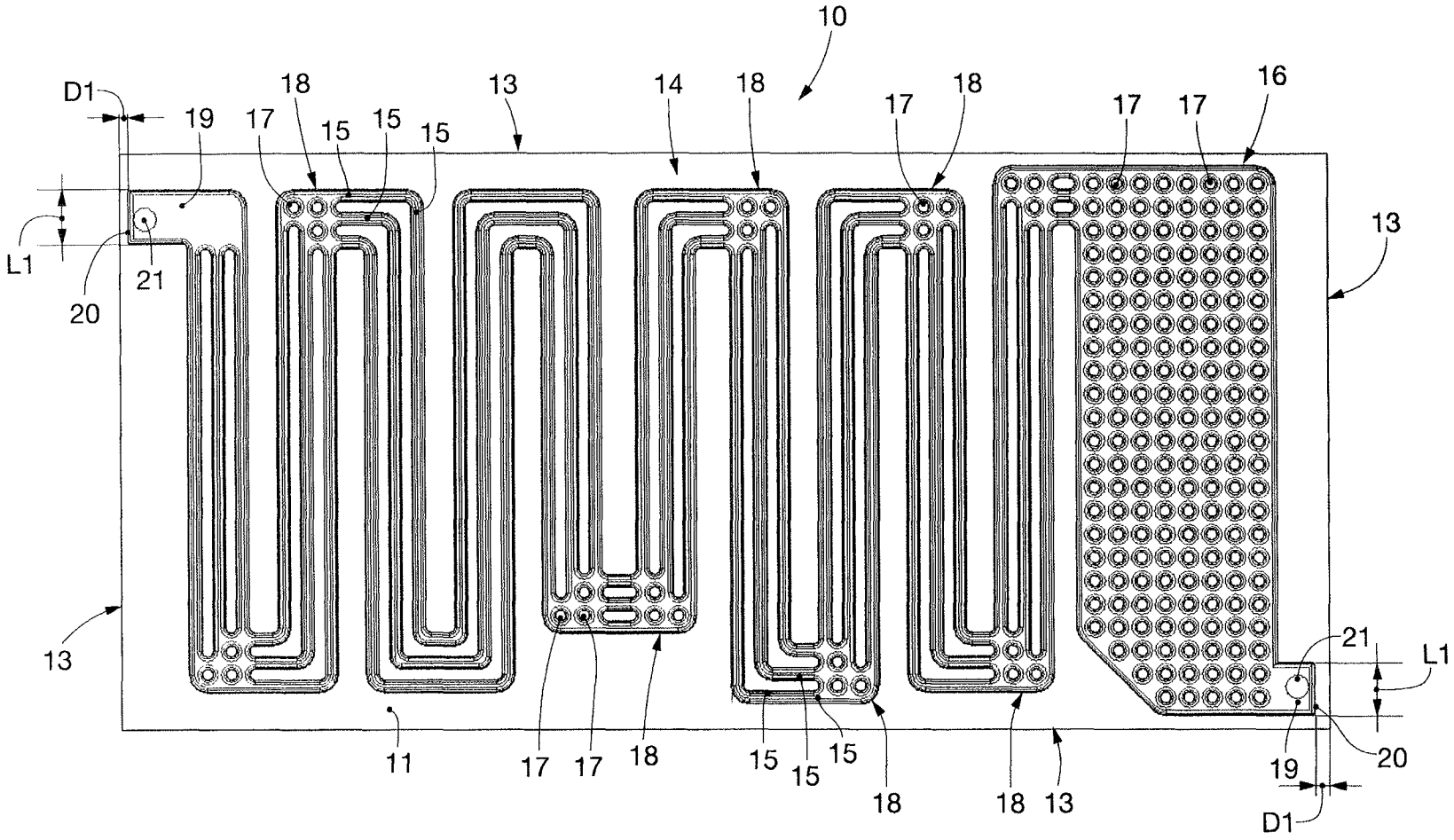
FIG. 1 is a plan view of an embodiment of a heat exchanger according to the present invention.
Figure 2:
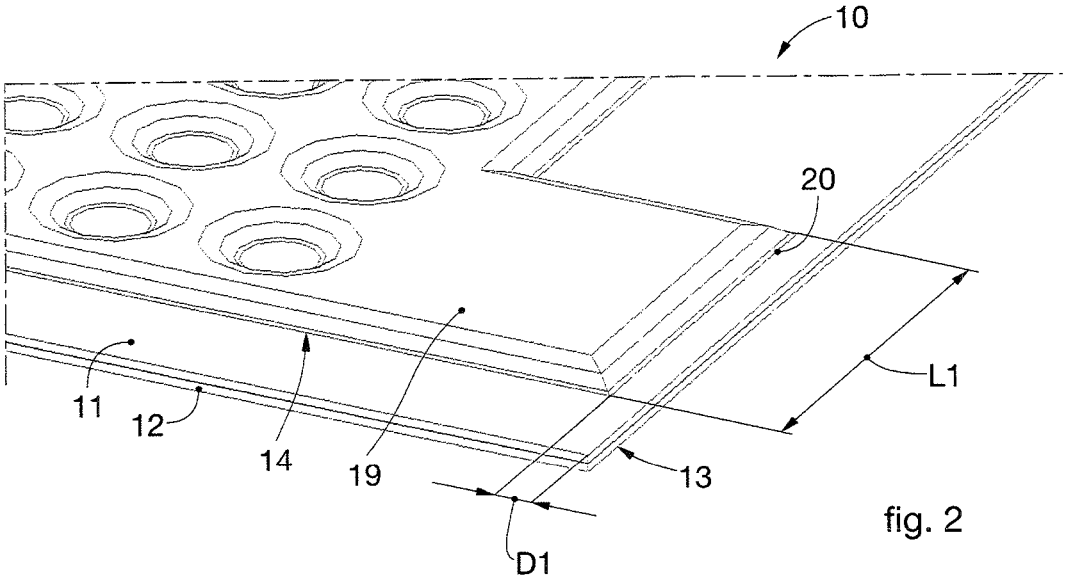
FIG. 2 is a three-dimensional view of a part of the heat exchanger of FIG. 1.
Figure 3:
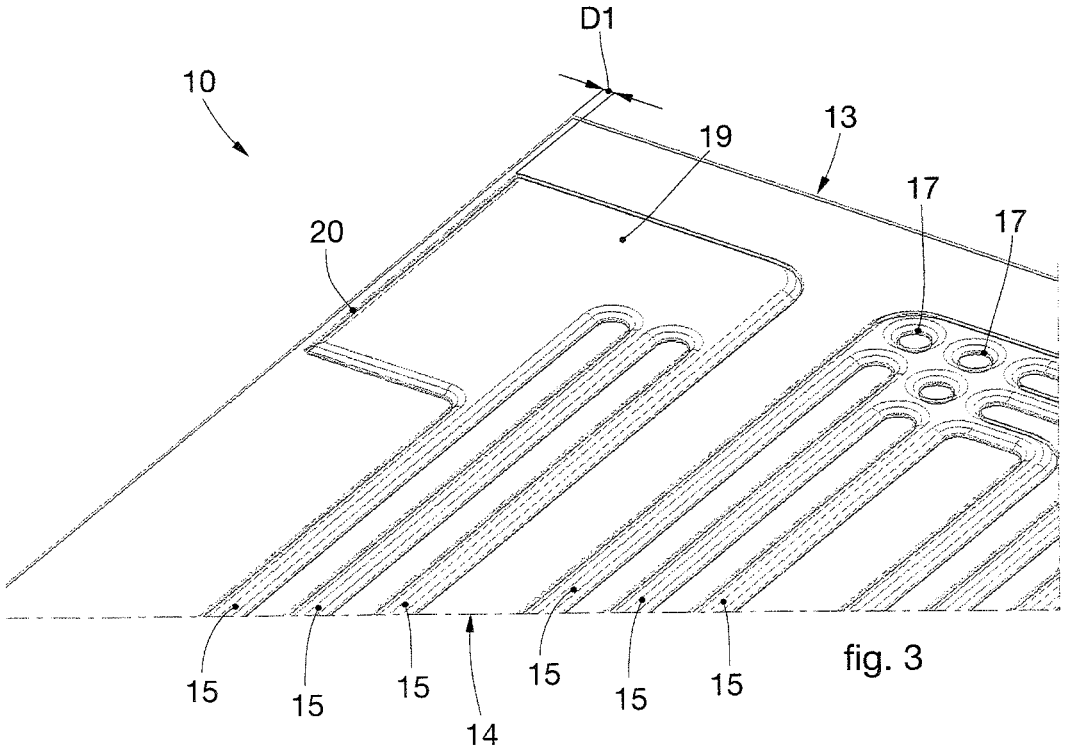
FIG. 3 is a three-dimensional view of a variant of the heat exchanger of FIG. 1.

With reference to the attached drawings and with particular reference to FIGS. 1, 2 and 3, a heat exchanger 10 according to the present invention comprises at least a first plate 11 and at least a second plate 12 overlapping and joined together, see FIG. 2.

Once the plates 11 and 12 have been made to overlap and joined together, it is possible to define a perimeter edge 13 of the heat exchanger 10, thus formed by the overlapping perimeter edges of the two plates 11, 12.

The plates 11, 12 have a substantially flat development, with a substantially uniform thickness. The plates 11, 12 can also have the same or different thickness.

The plates 11, 12 can be of any shape whatsoever, but preferably are square or rectangular in shape.

The plates 11, 12 are made of a material having a low thermal resistance, for example aluminum or an aluminum alloy. In particular, the choice of material also depends on the compatibility and chemical resistance to contact with various heat-carrier fluids, or better, as a function of the resistance to corrosion with respect to the latter.

On the plates 11 and 12, as explained below and by means of Roll-Bonding technology, a circuit 14 is made for the passage of a heat-carrier fluid.

The shape and configuration of the circuit 14 is defined in the design phase and therefore the circuit 14 comprises one or more channels 15 which branch out and/or join in various ways, as can be seen in FIG. 1.

Furthermore, it is possible to provide at least one channelized area 16 for heat exchange, in which branching points 17 are provided in which the two plates 11 and 12 are reciprocally joined.

As can be seen from FIG. 1, with the term channelized area we mean a sufficiently large heat exchange surface of the present heat exchanger 10, for example such that one of the sizes that define it is substantially equal to or slightly smaller than one of the two sides of the heat exchanger 10, for example the short side.

It is also possible to provide that the channels 15 extend in a straight or curved shape and that connection zone 18 are provided.

According to the Roll-Bonding technology, in a first step of producing the heat exchanger 10, on one of the plates 11, 12 a detaching material is deposited, for example by printing, according to the shape and path to be obtained for the circuit 14.

The plates 11, 12 are then made to overlap with in the middle the shape of the circuit 14 in detaching material and subjected to hot rolling. The circuit 14 will comprise at least one channel 15 and possible channelized areas 16 and/or connection zones 18 or other.

An aperture is left on the perimeter edge 13 obtained by overlapping the plates 11, 12 in order to allow the coupling of a device for introducing compressed air, or other fluid under pressure, which deforms at least one of the plates 11, 12 in correspondence with the detaching material. The fluid under pressure, substantially by inflation, produces one or more channels 15 between the plates 11, 12, as a function precisely of the desired shape of the circuit 14.

When the inflation process of the channels 15 is finished, it is possible to cut to size the two plates 11, 12, coupled and provided with a circuit 14, for example by shearing.

Figure 5:
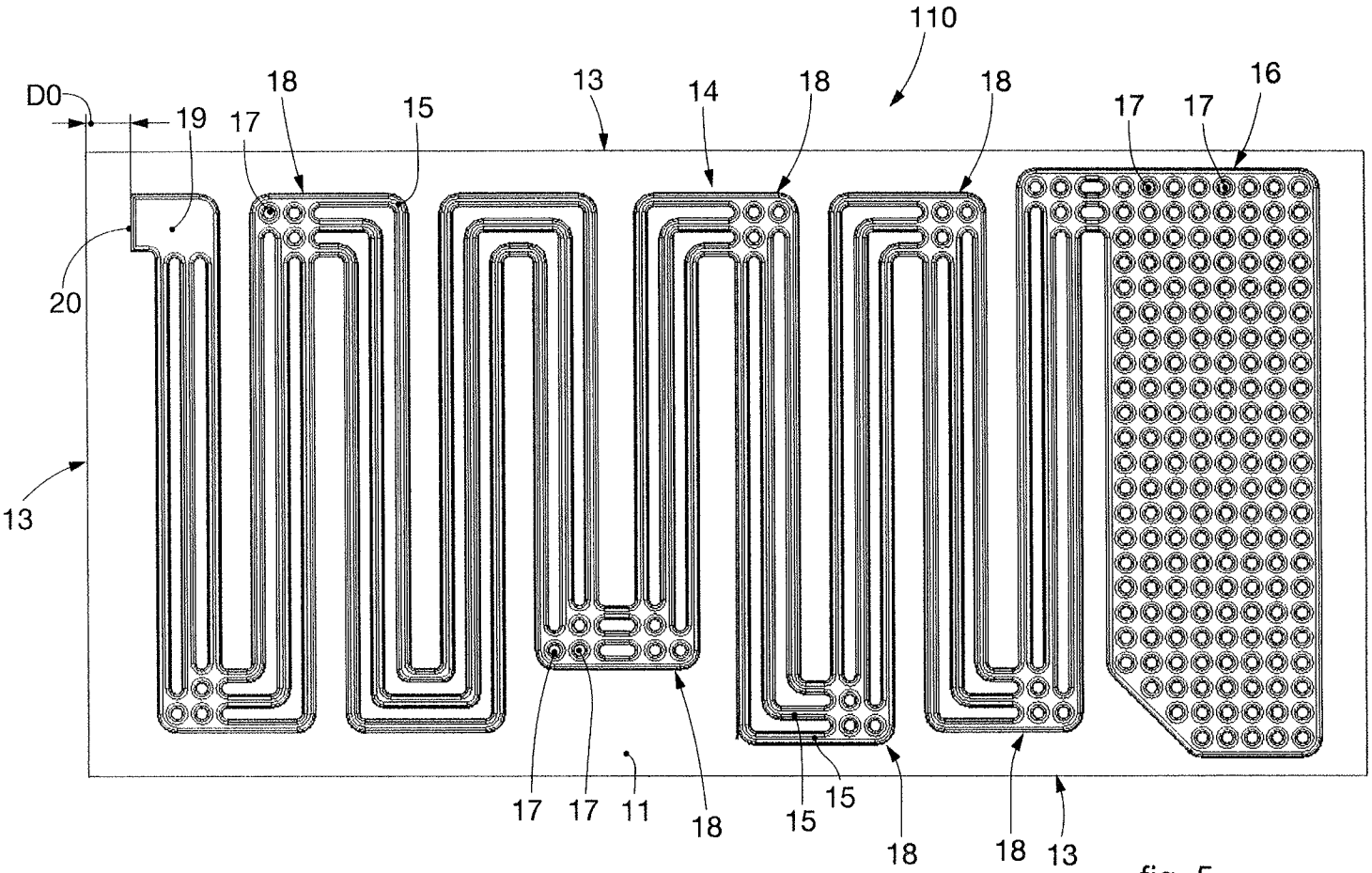
fig. 5 Prior Art
FIG. 5 is a plan view of an embodiment of a heat exchanger of the state of the art.

Due to what stated above with reference to the elongation of the material during the rolling step, and due to the need to guarantee a certain margin of tolerance, in the state of the art (see FIG. 5 in which the heat exchanger is indicated with 110, while components identical to those of FIG. 1 are indicated with the same reference number) a closing edge 20 of the heat exchange portion is maintained at a certain safety distance from the perimeter edge 13 of the plate. In this case, this distance is indicated with D0 and normally has a value of at least 35-40 mm. This entails a loss of overall efficiency of the exchanger, and the impossibility of bringing the heat exchange in proximity to the perimeter of the plates.

In the solution of the present invention, the circuit 14 is provided with at least one heat exchange portion 19 provided with a closing edge 20 which is made in proximity to the perimeter edge 13 of the heat exchanger 10, that is, at a minimum distance D1 from the perimeter edge 13, see for example FIG. 2, of up to 3-4 mm. During working, the heat exchange portion 19 is intentionally made to exit the trimming perimeter that defines the perimeter edge 13 of the heat exchanger 10; the two edges that make up the aperture between the plates 11, 12 will be closed during the finishing step, for example by welding.

In particular, in producing this type of circuit of the heat exchanger 10, the channelized areas 16 are voluntarily made to exceed the shearing limits, and the edges of the plates 11, 12 which delimit the surface of the heat exchanger 10 are closed together in the finishing step.

In the circuit 14 of FIG. 1, for example, two heat exchange portions 19 are provided located on opposite sides of the perimeter edge 13 of the heat exchanger 10.

It is possible, for example, to provide that a hole 21 for the inlet or outlet of a heat-carrier fluid is made in one of the heat exchange portions 19. In FIG. 1, for example, one heat exchange portion 19 has a hole 21 for the inlet of the heat-carrier fluid into the heat exchanger 10, and the other heat exchange portion 19 has a hole 21 for the outlet of the heat-carrier fluid from the heat exchanger 10.

A tubular element could be connected to the hole 21, positioned orthogonal or variously inclined with respect to the surface of the heat exchanger 10, defined in this example by the upper surface of the plate 11.

The distance D1 that separates the closing edge 20 of the heat exchange portion 19 from the perimeter edge 13 of the heat exchanger 10 is variable between about 3 mm and about 10 mm. The minimum distance can depend on the type of sealing system used.

The heat exchange portion 19 can have a width L1 which can be equal to the width of one of the channels 14, or it can be provided, preferably, with a width greater than the width of the single channel 14. The width L1 is in any case a function of the area to be cooled or heated, located in correspondence with the perimeter edge 13 and therefore the heat exchange portion 19.

Figure 4:
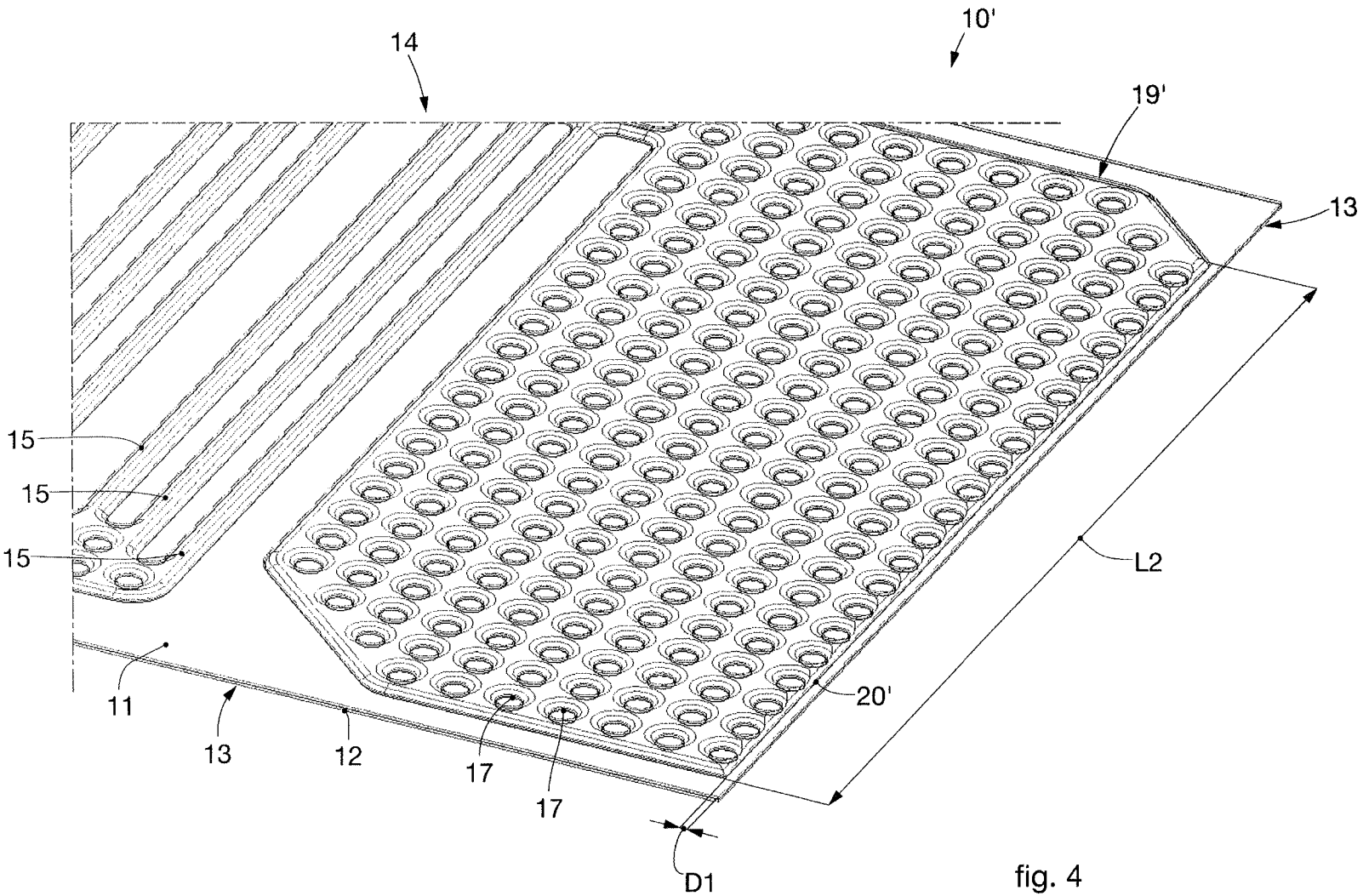
FIG. 4 is a three-dimensional view of a part of a variant embodiment of a heat exchanger according to the present invention.

In a variant of the heat exchanger 10', see FIG. 4, it is possible to provide that the heat exchange portion 19' coincides with an entire heat exchange channelized area. In this variant, the closing edge 20' extends for a width L2 such as to substantially occupy an entire side of the perimeter edge 13 of the heat exchanger 10. The closing edge 20' will be obtained in proximity to the perimeter edge 13, that is, at the minimum distance D1 from the perimeter edge 13.

During the design phase, it is possible to provide that, in correspondence with the zones of the circuit 14 where the heat exchange portions 19, 19' are to be obtained, the detaching material is deposited up to or beyond the perimeter edge 13 of the heat exchanger 10, 10' so that it is possible to generate, between the plates 11 and 12 and by inflation, the necessary aperture that defines the channelization inside the heat exchange portion 19, 19'.

The closure of the heat exchange portion 19, 19', and therefore the production of the closing edge 20, 20', occurs during a finishing step of the heat exchanger 10 following shearing.

This closure, and therefore the production of the closing edge 20, can occur, for example, by bending the perimeter edge 13 of the plates 11, 12, providing that the heat exchange portion 19 is provided with a segment protruding out of the perimeter edge 13 of the heat exchanger 10.

The closing edge 20, 20' could also be obtained by welding the plates 11, 12 in proximity to the perimeter edge 13, for example with a TIG, MIG, or MAG type welding, or made with LASER.

Another mode to produce the closing edge 20, 20' of the heat exchange portion 19, 19' could be by gluing the plates 11, 12 in proximity to the perimeter edge 13 and subsequent shearing, always providing that the heat exchange portion 19, 19' protrudes by a certain segment from the perimeter edge 13 of the heat exchanger 10, 10'.

In accordance with possible embodiments, the closing edge 20, 20' can be produced by a combination of welding, bending and/or gluing.

Essentially, therefore, by already providing during the design phase a heat exchange portion 19, 19' of suitable sizes, then providing at least one strip of detaching material between the two plates 11, 12 that reaches up to or beyond the perimeter edge 13, before the finishing step, it is possible to define in the geometry of the heat exchanger 10 one or more positions in which, regardless of the sliding of the material during rolling, it will be possible to intercept a heat exchange portion, that is, the heat exchange portion 19, 19'.

Advantageously, by providing the heat exchange portions 19, 19' it will be possible, for example, to define during the design phase the position of a tubular element, for example an orthogonal or inclined connector, to be connected to the hole 21.

In summary, in embodiments of the invention, the present method to produce a heat exchanger 10, 10' substantially provides:

- at least one deposition step, to deposit on at least one of two plates 11, 12 a detaching material according to the shape and path of the heat exchange circuit 14 to be obtained;
- the overlapping and hot rolling of the plates 11, 12 with in the middle the template of the circuit 14 made of detaching material;
- the introduction of a fluid under pressure from an inflation aperture made on one of the perimeter edges 13 made by overlapping the plates 11, 12 and consequent deformation of at least one of the plates 11, 12 in correspondence with the detaching material, thus obtaining, by inflation, one or more channels 15 and wherein part of one or more channels 15 is made open toward one of the perimeter edges 13, in particular in a different position from the inflation aperture,
- the closing, in the finishing step, of said part of the one or more channels 15, thus producing a closing edge 20, 20' located in proximity to the perimeter edge 13 of the heat exchanger, that is, at a minimum distance D1 from the perimeter edge 13 and defining a heat exchange portion 19, 19'.

It is clear that modifications and/or additions of parts may be made to the heat exchanger and to the corresponding production method as described heretofore, without departing from the field and scope of the present invention.

It is also clear that, although the present invention has been described with reference to some specific examples, a person of skill in the art shall certainly be able to achieve many other equivalent forms of heat exchanger, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A method to produce a heat exchanger (10, 10'), comprising at least two plates (11, 12) of metal material having a pre-defined shearing perimeter, overlapping and joined together so as to define a perimeter edge (13) beyond the shearing perimeter and at least one circuit (14) for the passage of a heat-carrier fluid defined by at least one or more heat exchange channels (15) made between said plates (11, 12), wherein said method comprises:

at least one deposition step, to deposit on at least one of two plates (11, 12) a detaching material according to the shape and the path of the heat exchange circuit (14) to be obtained;

the overlapping and hot rolling of said plates (11, 12) with in the middle the template of the circuit (14) made of detaching material;

the introduction of a fluid under pressure from at least one aperture made on a perimeter edge (13) made by overlapping the plates (11, 12) and consequent deformation of at least one of the plates (11, 12) in correspondence with said detaching material, thus obtaining, by inflation, one or more channels (15) and at least one heat exchange portion (19, 19') extending beyond the shearing perimeter and situated in proximity to the perimeter edge (13) of the heat exchanger, that is, at a minimum distance (D1) from said perimeter edge (13), cutting the plates (11, 12) along the shearing perimeter, resulting in an exposed aperture of the heat exchange portion (19, 19'), and closing the exposed aperture in a finishing step, thereby forming a closing edge (20, 20') of the heat exchange portion (19, 19').

2. The method as in claim 1, wherein said closing edge (20, 20') is made by bending the perimeter edge (13) of the plates (11, 12).

3. The method as in claim 1, wherein said closing edge (20, 20') is made by welding the plates (11, 12) in the finishing step in proximity to said perimeter edge (13) of the heat exchanger (10, 10').

4. The method as in claim 1, wherein said closing edge (20, 20') is made by gluing the plates (11, 12) in the finishing step in proximity to said perimeter edge (13), and subsequent shearing.

5. The method as in claim 1, wherein, to obtain said heat exchange portion (19, 19'), at least one strip of detaching material is disposed between said plates (11, 12) beyond the perimeter edge (13) of the heat exchanger (10, 10').

6. A heat exchanger obtained with the method as in claim 1, comprising the at least two plates (11, 12) of metal material, overlapping and reciprocally joined together so as to define the perimeter edge (13) of the heat exchanger and the at least one circuit (14) for the passage of a heat-carrier fluid defined by the at least one or more heat exchange channels (15) made between said plates (11, 12), wherein said circuit (14) is provided with the at least one heat exchange portion (19, 19') having the at least one closing edge (20, 20') which is made in proximity to the perimeter edge (13) of the heat exchanger, that is, at a minimum distance (D1) from said perimeter edge (13) variable from about 3 mm to about 7 mm.

7. The heat exchanger as in claim 6, wherein the width (L1, L2) of said heat exchange portion (19, 19') is greater than the width of a single heat exchange channel (15).

8. The heat exchanger as in claim 6, wherein said heat exchange portion (19') is defined by at least one channelized area made on said heat exchange circuit (14) and provided with a series of branching points (17).

9. The heat exchanger as in claim 6, wherein said heat exchange portion (19) comprises one or more holes (21) for the inlet or outlet of the heat-carrier fluid to/from the heat exchanger.

* * * * *